United States Patent [19]

Neugart

[11] 4,234,303

[45] Nov. 18, 1980

[54] COMBUSTION APPARATUS

[76] Inventor: Fernando M. Neugart, 32-21 37th St., Astoria, N.Y. 11103

[21] Appl. No.: 949,662

[22] Filed: Oct. 10, 1978

[51] Int. Cl.[3] ..... F23D 3/16

[52] U.S. Cl. ..... 431/293; 431/291; 431/320

[58] Field of Search ..... 431/289, 291, 293, 298, 431/320

[56] References Cited

U.S. PATENT DOCUMENTS

| | | | |
|---|---|---|---|
| 977,567 | 12/1910 | Sterling | 431/293 |
| 3,183,688 | 5/1965 | Sobelson | 431/298 |

FOREIGN PATENT DOCUMENTS

| | | | |
|---|---|---|---|
| 2396 | of 1884 | United Kingdom | 431/293 |

*Primary Examiner*—Carroll B. Dority, Jr.

*Attorney, Agent, or Firm*—Mark T. Basseches; Paula T. Basseches

[57] ABSTRACT

The present invention is directed to an improved combustion apparatus particularly adapted for use with fuels which are solid at ambient temperatures and readily meltable at temperatures exceeding ambient, an example of such fuel being paraffin. The apparatus includes a two-part float assembly adapted to float upon the molten surface of the fuel and includes a heat conductive bottom plate, the device being characterized by efficient heat transfer from the flame to the bottom plate, whereby it is assured that the fuel beneath the plate will be in a molten condition.

6 Claims, 3 Drawing Figures

FIG. 1
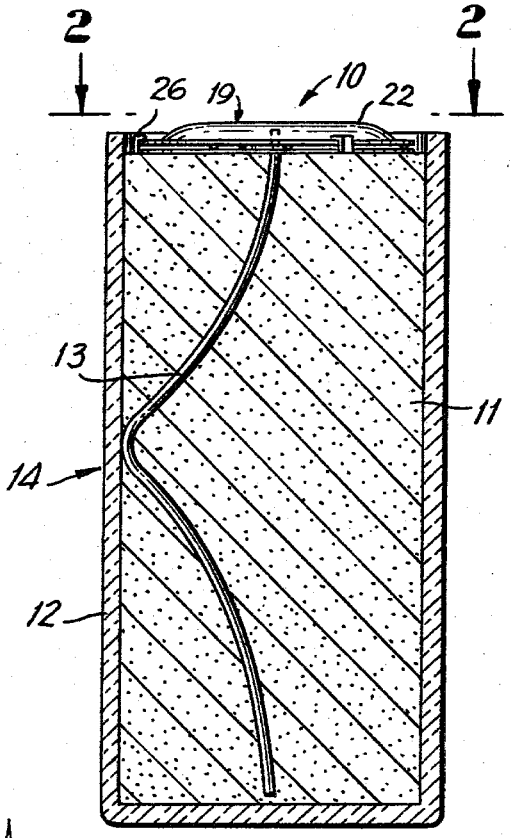
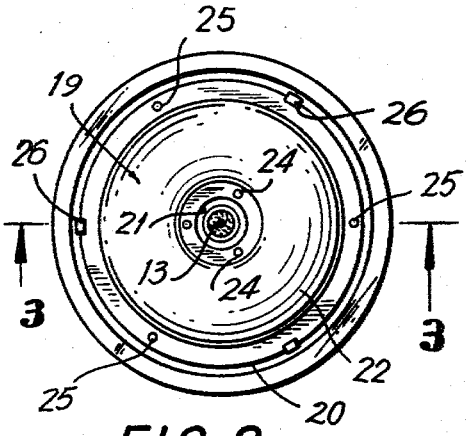
FIG. 2
FIG. 3
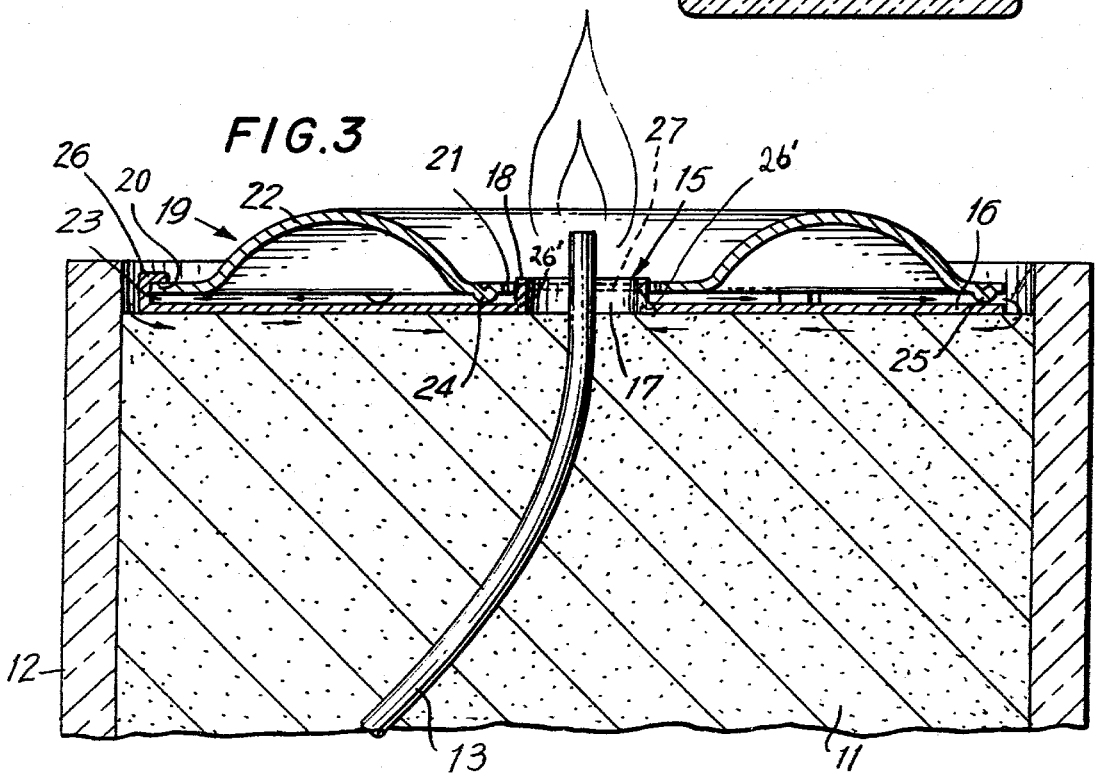

COMBUSTION APPARATUS

BACKGROUND OF THE INVENTION

1. Field of the Invention

The present invention is directed to a combustion device, and more particularly to a device intended to be used in conjunction with a candle of the type wherein paraffin components are contained within a jar or other vessel.

2. The Prior Art

In my U.S. Pat. No. 4,013,397 there is disclosed a device of the type of which the present invention constitutes an improvement. More particularly, there is shown in the said patent a metallic float device adapted to carry a short wick section or to surround the existing wick of a vessel contained candle-like assembly.

In accordance with the teachings of said patent, the metal float device is supported on the surface of a body of paraffin and heat developed by the flame at the wick is transmitted to the float, the transmitted heat in turn serving to melt the fuel directly beneath the float, whereby the float is permitted to move progressively toward the bottom of the container as the fuel is consumed.

While the device of said patent is effective for its intended purpose, instances have been observed where heat transfer from the flame to the float is insufficient completely to melt the fuel beneath the plate, with the result that the plate is unable to descend the column of fuel. When the molten fuel fails to reach the wick, the flame will be extinguished.

Such condition has been observed particularly where the device is burned in an extremely cool environment, resulting in a relatively rapid conduction of heat away from the plate.

The occasional failure of the prior art device described is considered to result from the fact that heating of the fuel beneath the plate was effected substantially only as a result of radiation and conduction of the heat from the candle flame.

SUMMARY OF THE INVENTION

The present invention may be summarized as directed to an improved combustion device of the type described in U.S. Pat. No. 4,013,397, the improved operation of the device being the result of more efficient heat transfer from the candle flame to the float device, and particularly to the bottom portion thereof, with resultant more efficient melting of the fuel beneath the device.

More particularly, the present invention achieves a more effective utilization of heat from the candle flame as the result of a construction operating on a heat transfer utilizing radiation, conduction and convection principles.

Briefly, the combustion apparatus includes a bottom plate which, in operation, will contact the solid fuel, a top plate secured to the bottom plate, portions of the top plate being spaced from the bottom plate to provide an air chamber or float, the plates being so connected as to define a radially directed flow path therebetween, whereby heat of the candle flame applied at the center of the device will be transmitted to the bottom plate by radiation and conduction but, by virtue of the existence of the radial path, there will also be set up a convective flow of heated fuel, whereby the temperature of the bottom plate will be maintained at a high value and more efficient melting of the fuel will be achieved.

Accordingly, it is an object of the invention to provide a combustion device adapted to float on the surface of fuel which is solid at ambient temperatures and which becomes melted when heated to temperatures somewhat above ambient.

More particularly, it is an object of the present invention to provide an improved combustion device of the general type disclosed in my U.S. Pat. No. 4,013,397 wherein more effective transfer of the heat of the candle flame to the combustion device is achieved, with resultant improved melting of the solid fuel.

Still a further object of the invention is the provision of an inexpensive and effective combustion device wherein the possibility of failure resulting from non-melting of the fuel is greatly reduced.

To attain these objects and such further objects as may appear herein or be hereinafter pointed out, reference is made to the accompanying drawings, forming a part hereof, in which:

FIG. 1 is a vertical sectional view through a combustion apparatus in accordance with the invention, the apparatus being displayed in conjunction with a container filled with solid fuel;

FIG. 2 is a plan view taken in the direction of the arrows 2—2 of FIG. 1;

FIG. 3 is a magnified vertical section taken on the line 3—3 of FIG. 2.

As shown in the drawings, and particularly FIG. 1, a combustion device 10 is disclosed, the device being adapted particularly for use with a meltable fuel mass 11, such as a mass of paraffin, contained in a glass vessel, such as the vessel 12.

As more fully set forth in my above referenced patent, it often occurs in devices of the type described that the wick member 13 is arrayed in the container 12 in such manner that at some point or other, e.g. in the area 14, the wick closely approaches the wall of the container. When this condition occurs, if the device is used in the manner of a conventional candle, it will be readily recognized that the flame so closely approaches the wall of the vessel that it is possible to crack the vessel, with resultant danger.

The combustion device of the present invention assures even and effective burning of the column of combustible fuel 11 and positively prevents overheating of the walls of the container by maintaining the wick 13 in spaced relation to the glass walls as the result of the wick passing upwardly through a central area 15 formed in the combustion device 10.

While the present invention has been illustrated in conjunction with a candle-like apparatus incorporating a wick 13, it will be readily understood by reference to my above cited patent that the apparatus may be used to burn a fuel mass not having its own wick by using a short wick section maintained within the central area 15 of the combustion apparatus by a wick retainer mechanism of the sort shown in said patent. The wick may be supported by a suitable wire 27 connected to rim 18 if desired.

With further reference to the construction of the combustion apparatus, the same includes a conductive metallic bottom plate 16 which is generally planar and includes a central aperture 17 which may be surrounded by a shallow, upwardly directed inner rim 18. A cover plate 19, which is substantially congruent in plan to the bottom plate 16, includes an outer peripheral portion 20, an inner aperture portion 21, and a raised annular central portion 22 spaced from the plane of the bottom plate 16, to define an air chamber between such parts.

The top and bottom plates 16 and 19 are connected together in such manner that a substantially continuous radially extending slot or space 23 is defined between the noted plates. The vertical extent of the radial slot 23 has been exaggerated in the illustration for purposes of clarity, and the spaces may be of capillary dimension.

The desired spacing of the plates may be provided by forming an inner and an outer series of downwardly directed dimples or indentations 24 and 25, respectively, on the top plate. Alternatively, the irregularities in the metal surfaces may provide sufficient spacing merely to permit the two metal pieces to touch lightly.

The plates are held together by a series of tongues or tabs 26 formed on the bottom plate and outwardly lapping the periphery 20 of the top plate.

Preferably, a series of small apertures 26 may be formed in bottom plate 16 at the junction of the plate and rim 18. The apertures 26' assure the presence of a sufficient supply of molten fuel in the radial slot 23 formed between the plates 16, 19. The importance of the radially extending slot 23 will be understood in connection with a description of the operation of the device which follows.

When the wick portion 13 has been ignited, the flame, by radiation and conduction, will heat portions of the top and bottom plates adjacent the central aperture 15. The heat will travel outwardly through the bottom plate and will, in turn, melt areas of the fuel in direct contact with the bottom plate, whereby the entire apparatus will float on a shallow pool of molten fuel.

In addition, by virtue of the spacing of the plates as aforesaid, there will be set up in the combustion apparatus a radial outward convective flow in the direction of the arrows, FIG. 3, wherein the hotter fuel portions tend to rise at the center area 15, pass through apertures 17 and 26', flow laterally outwardly through the radial space 23, and then downwardly at the periphery 20. The convective flow is, of course, the result of the tendency of the heated fuel adjacent the center to rise and laterally displace the somewhat cooler portions, which are caused to flow radially outwardly and to an extent perhaps, the capillary spacing of the adjacent plates defining the slot.

It will be appreciated that the fuel, as it approaches the periphery, will become progressively cooler as the result of the transfer of heat to the bottom plate 16.

From the foregoing it will be evident that, in contrast to the combustion device of my above referenced patent wherein heating of the bottom plate is effected substantially entirely by conduction and radiation from the candle flame, convective heating of the bottom plate being prevented by virtue of the fact that the plates are sealed together, the device of the instant invention causes a heating of the bottom plate through each of the media of conduction, radiation and convection, the latter heating effect being the result of providing a radially extending slot.

The device in accordance with the invention has been found to operate satisfactorily even under circumstances in which the candle apparatus is burned in an environment wherein the ambient temperatures are quite cool. The device has thus been found more efficient than that disclosed in my U.S. Pat. No. 4,013,397, although the latter is effective under most circumstances.

Having thus described the invention and illustrated its use, what is claimed as new and is desired to be secured by Letters Patent is:

1. A combustion apparatus for use with a low temperature meltable solid fuel, such as paraffin, comprising, in combination, a bottom, generally planar conductor plate formed of metal and having a high thermal conductivity factor, said plate including a central bore extending transversely therethrough and defining a wick receiver aperture, a cover plate member substantially congruent to said conductor plate and secured thereto in overlying relation to the upper surface of said conductor plate, said cover plate including a central portion defining an aperture in registry with and disposed adjacent the aperture in said conductor plate, an outer peripheral portion in registry with and disposed adjacent the periphery of said conductor plate, and a central portion spaced from said conductor plate, said conductor plate and said cover plate defining therebetween a substantially continuous, radially directed flow passage for molten fuel heated adjacent said central aperture, whereby an annular convective flow path for heated fuel is created between said plates to augment the heating of said bottom plate, with consequent improved heat transfer to the fuel below said bottom plate.

2. Apparatus in accordance with claim 1 wherein said bottom plate includes a shallow heat collector rim surrounding said aperture.

3. Apparatus in accordance with claim 2 wherein said bottom plate includes apertures adjacent the junction of said plate and rim.

4. Apparatus in accordance with claim 1 and including spacer means interposed between said plates whereby said plates are maintained in proximate parallel planes, spaced apart in accordance with the depth of said spacer means, thereby to define said radial flow passage.

5. Apparatus in accordance with claim 4 and including wick holder means disposed within said registering apertures of said plates for supporting a short wick section.

6. Apparatus in accordance with claim 1 wherein portions of the space between said upper and lower plates are of capillary dimension.

* * * * *